United States Patent [19]

Shimizu

[11] Patent Number: 4,533,270

[45] Date of Patent: Aug. 6, 1985

[54] PRINTING PAPER FEED RELEASING DEVICE FOR PRINTERS

[75] Inventor: Munetaka Shimizu, Kawagoe, Japan

[73] Assignee: Copal Company Limited, Tokyo, Japan

[21] Appl. No.: 428,611

[22] Filed: Sep. 30, 1982

[30] Foreign Application Priority Data

Sep. 30, 1981 [JP] Japan ..... 56-145904[U]

[51] Int. Cl.[3] ..... B41J 13/03

[52] U.S. Cl. ..... 400/636; 101/93.31; 400/617

[58] Field of Search ..... 400/637.1, 619, 637, 400/637.2, 637.3, 637.4, 637.5, 637.6, 636.1, 634, 636, 617; 101/93.31, 93.28–93.30; 226/154, 155

[56] References Cited

U.S. PATENT DOCUMENTS

| | | | |
|---|---|---|---|
| 980,689 | 1/1911 | Smith | 400/636.1 |
| 1,053,207 | 2/1913 | Myers | 400/637.1 |
| 2,131,149 | 9/1938 | Smith | 400/637.1 |
| 3,995,547 | 12/1976 | Shimodaira et al. | 101/93.31 |
| 4,173,420 | 11/1979 | Okabe | 400/636.1 |
| 4,328,747 | 5/1982 | Fujiwara et al. | 101/93.09 |
| 4,373,439 | 2/1983 | Mikoshiba | 101/93.09 |

FOREIGN PATENT DOCUMENTS 2830227 2/1979 Fed. Rep. of Germany ... 101/93.09

OTHER PUBLICATIONS

Klein et al., Paper Table Actuated Feed Rollers and Paper Gate, vol. 17, No. 5, Oct. 1974, pp. 1263, 1264, IBM Tech. Discl. Bulletin.

Roy et al., Automatic Mechanical Paper Bail Closer, vol. 22, No. 6, Nov. 1979, pp. 2173, 2174, IBM Tech. Discl. Bulletin.

*Primary Examiner*—Edgar S. Burr
*Assistant Examiner*—M. J. Hirabayashi
*Attorney, Agent, or Firm*—Cushman, Darby & Cushman

[57] ABSTRACT

In order that a printing paper feed device is able to be set in an inoperative condition with a simple operation and that the printing paper feed device is able to return automatically to an operative condition with restart of a printer, a printing paper feed releasing device for printers is provided with a releasing lever able to bring a printing paper guide to the releasing position, a lock lever able to lock the releasing lever in the operated position, and a supporting shaft or a cam plate able to bring the lock lever to the position, wherein the lock against the releasing lever will be released when the printer restarts.

1 Claim, 6 Drawing Figures

PRINTING PAPER FEED RELEASING DEVICE FOR PRINTERS

BACKGROUND OF THE INVENTION (a) Field of the Invention

The present invention relates to a printer to print letters, symbols and the like on a strip printing paper, and particularly to an improvement of a printing paper feed release device.

(b) Description of the Prior Art

In a printer to print letters, symbols and the like on a strip printing paper, the printing paper is generally guided by a guiding member and is fed to a prescribed direction by driving a paper feed roller which feeds the printing paper in cooperation with a pressure roller. When it is necessary to remove the printing paper or when some trouble occurs in the feed of the printing paper, the guiding member will be released by manual operation and the feed roller and the pressure roller will be disengaged from each other to release the printing paper.

In such a conventional type of printing paper feed release device, an operator must perform manual operation to release the guiding member for a required duration when it is necessary to remove the printing paper or when some trouble occurs in the feed of the printing paper. This makes very inconvenient the handling of the printer. To resolve this inconvenience, there has been proposed a printer which has a mechanism wherein an operating member to release the guiding member is able to be locked in the operated position. However, in such formation, the operator might forget to unlock the operating member after inserting a new printing paper roll or after removing trouble associated with the printing paper feed. Therefore, there exists the undesirable possibility that the printer may be restarted in a condition when it is unable to feed the printing papers.

SUMMARY OF THE INVENTION

A primary object of the present invention is to provide a printing paper feed release device so arranged that the lock of an operating member to release a guiding member for a printing paper is released by a member to be driven with the restarting of a printer and the guiding member is automatically returned to the regular position.

Another object of the present invention is to provide a printing paper feed release device simple in its constitution and able to be easily operated.

These and other objects of the present invention will become more apparent during the course of the following detailed description and appended claims.

DESCRIPTION OF THE PREFERRED EMBODIMENTS

Figure 1:
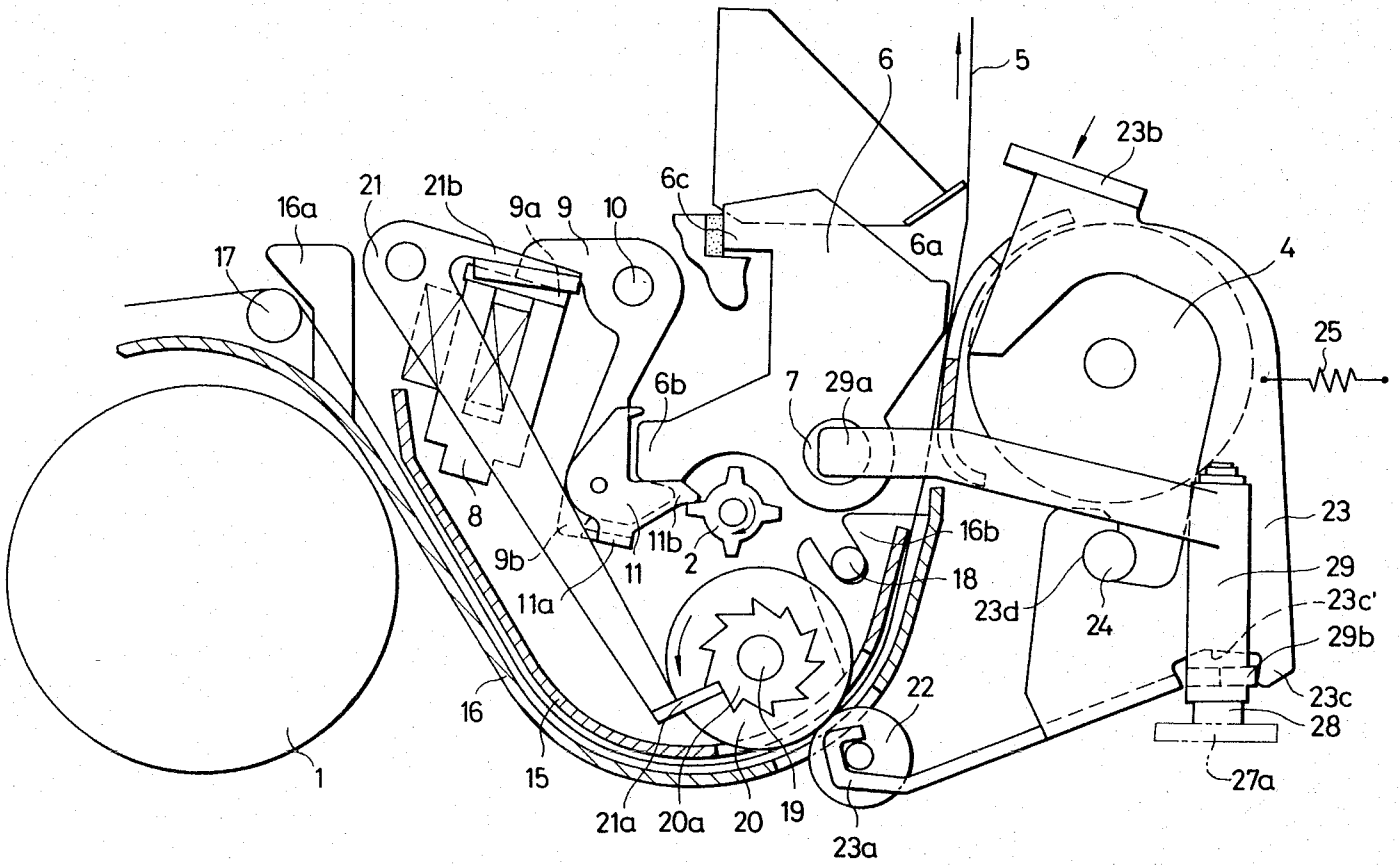
FIG. 1 is a side view of a printer showing an embodiment of the printing paper feed release device according to the present invention.
Figure 2:
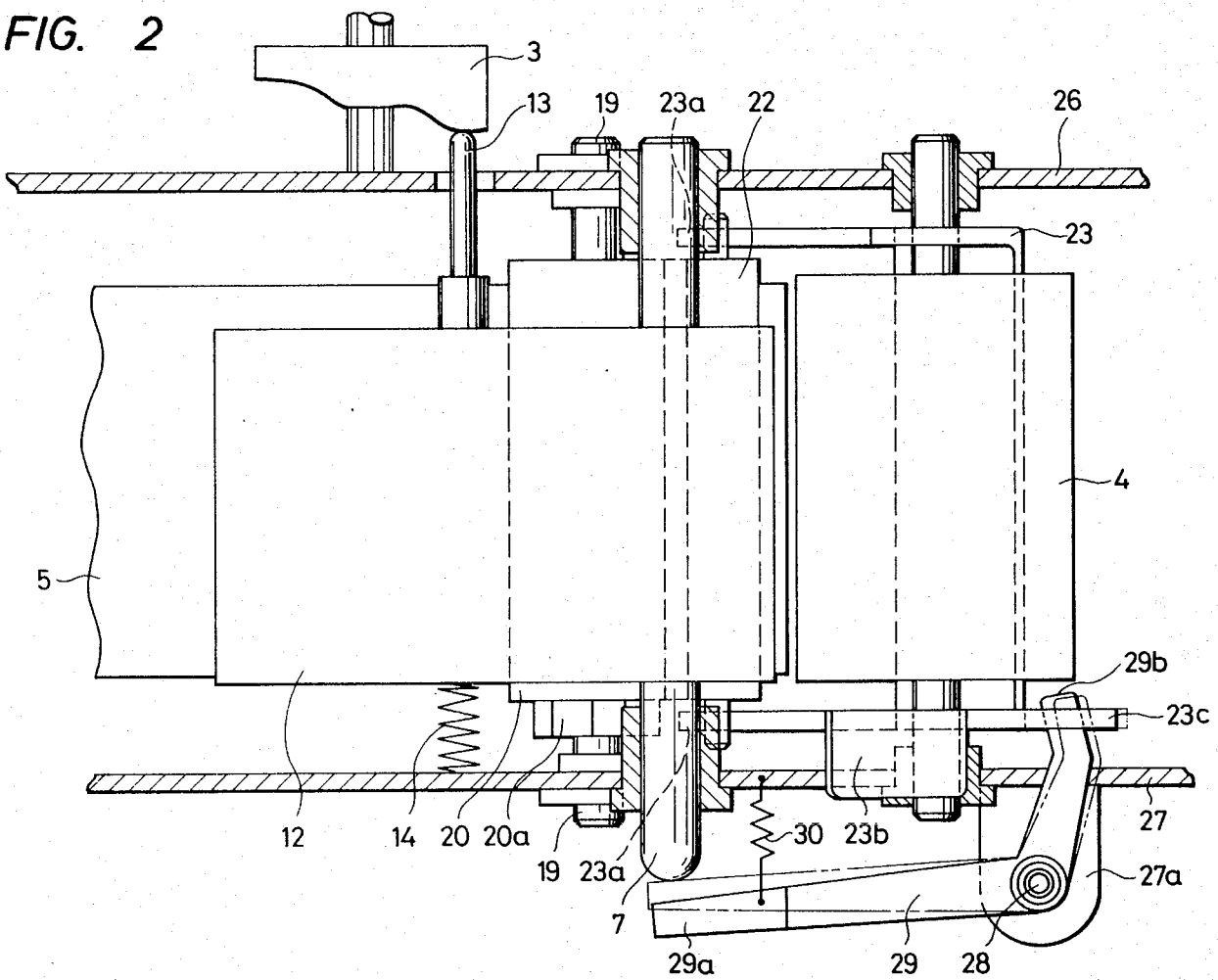
FIG. 2 is a plane view of FIG. 1.

In FIGS. 1 and 2, the numeral reference 1 denotes a motor which is a driving source of a printer; 2 denotes an operating cam to be rotated by the motor 1 through a transmitting means (not illustrated;) 3 denotes a stepped cam, for example three stepped cams formed along the circumference of the end face of a disk and rotated by the motor 1 through the transmitting means (not illustrated); 4 denotes a printing roller provided with a number of numerals, letters and symbols arranged longitudinally and latitudinally in a prescribed order and rotated by the motor 1 in synchronization with the stepped cam 3. The cam 3 is synchronized with the printing roller 4 so as to be shifted by one step according to one rotation of the printing roller. 5 denotes printing paper; 6 denotes a printing hammer having a hammer head 6*a* able to hit the printing roller 4 supporting the printing paper 5 together with the printing roller 4, an operating arm 6*b* and a projection 6*c* and fixed on a supporting shaft 7 arranged slidably to the thrust direction. 8 denotes an electromagnet fixed on a printer body. 9 denotes a selecting lever having an armature 9*a* and a stopper 9*b*, biased clockwise and movable to the position to make the printing hammer 6 perform printing operation when it is turned counter-clockwise by the energization to the electromagnet 8; 11 denotes a selecting nail having a bending part 11*a* engaged with the stopper 9*b* of the selecting lever and an operating arm 11*b* engaged with the operating arm 6*b* of the printing hammer 6 and engageable with the operating cam 2 and biased clockwise by a spring not illustrated and pivoted on the selecting lever 9 near to the stopper 9*b* of the selecting lever 9. The printing hammer 6, electromagnet 8, selecting lever 9 and selecting nail 11 constitute a hammer operating mechanism, and a plurality of the hammer operating mechanisms arranged for every three rows of printing types of the printing roller respectively constitute a hammer operating unit 12. 13 denotes a figure shifting-up pin fixed on the hammer operating unit 12 and engaged with the stepped cam 3; 14 denotes a compression spring to force the hammer operating unit 12 toward the stepped cam 3. This hammer operating unit 12 will be shifted stepwise by each one figure of the printing types arranged in rows for every one rotation of the printing roller 4 depending on the stepped cam 3, and will repeat this stepwise operation returning back to the original position by shifting every three rows. Further, this hammer operating unit 12 is controlled by a controlling means (not illustrated) so that it will stay at the most shifted up position in FIG. 2 when the printer is stopped. 15 and 16 denote respectively an upper guide and a lower guide for the printing paper 5. The lower guide 16 is arranged slidable rightward and downward as shown in FIG. 1 through the guiding arms 16*a* and 16*b* engaged with pins 17 and 18. 19 denotes a paper feed shaft attached to the printer body and rotatably interlocking with the motor 1; 20 denotes a paper feed roller having a ratchet 20*a* and coupled with the paper feed shaft 19 through a spring clutch (not illustrated); 21 denotes a paper feed lever having a nail 21*a* to be engaged with the ratchet 20*a* on one arm end and an armature part 21*b* able to be attracted by the electromagnet 8 on the other arm end. 22 denotes a pressure roller pressed on the paper feed roller 20 through the printing paper 5; 23 denotes a paper feed release lever having a supporting part 23*a* on one arm end to rotatably support the pressure roller 22, an operating part 23*b* able to be operated manually on the other arm end and an engaging part 23*c* and rotatably supported on a supporting shaft 24 with a supporting part 23*d*; 25 denotes a spring to bias clockwise the paper feed release lever 23. 26 and 27 denote a body frame respectively, and the frame 27 has a bending part 27*a* and a shaft 28 is erected on the bending part 27*a*. 29 denotes a lock release lever having an operating arm 29*a* pivoted on the shaft 28 and engageable with the end of the supporting shaft 7 of the printing hammer 6, and an arm 29*b* engageable with the engaging part 23*c* of the paper feed release lever 23. 30 denotes a spring to bias clockwise the lock release lever 29.

Although the printing operation in the printer of the above formation is well-known, a brief explanation of its operation shall be made in the following.

When the motor 1 starts to move, the operating cam 2 and printing roller 4 will start to rotate, the stepped cam 3 to be rotated in synchronization with the printing roller 4 will move the figure shifting-up pin 13 of the hammer operating unit 12 by one figure for the one rotation of the printing roller 4, and will return to the original position after having moved the hammer operating unit 12 by three figures for the three rotations of the printing roller 4. When the printing type to be printed in each row arrives in a position able to be struck by the printing hammer 6, the electromagnet 8 will be energized by a control means (not illustrated), the selecting lever 9 will be rotated counter-clockwise by the attractive force of the electromagnet 8, the selecting nail 11 pivoted to the free end of the selecting lever 9 will make advance the operating arm 11*b* to the position enable to be engaged with the operating cam 2 and will be rotated counter-clockwise by engaging with the operating cam 2 which is rotating clockwise interlocking with the motor 1, the operation arm 11*b* will simultaneously push up the arm 6*b* of the printing hammer 6 and the printing hammer 6 will be rotated clockwise and will press the printing paper 5 on the printing type of the printing roller 4 to print the desired letter or symbol on the printing paper 5. The printing paper 5 will be guided by the fixed pin 17, the upper guide 15 and the lower guide 16 from a paper roll (not illustrated) will be pressed between the paper feed roller 20 and pressure roller 22, and will be fed by one line by the paper feed roller 20 when the printing of one line is completed. That is, when the printing of one line is completed, an electromagnet (not illustrated) will be energized, the paper feed lever 21 be rotated clockwise by the attractive force of the electromagnet (not illustrated), the engagement between the nail 21*a* and ratchet 20*a* will be released and the paper feed roller 20 will feed the printing paper 5 by one line by coupling with the paper feed shaft 19 through the spring clutch (not illustrated).

Figure 3:
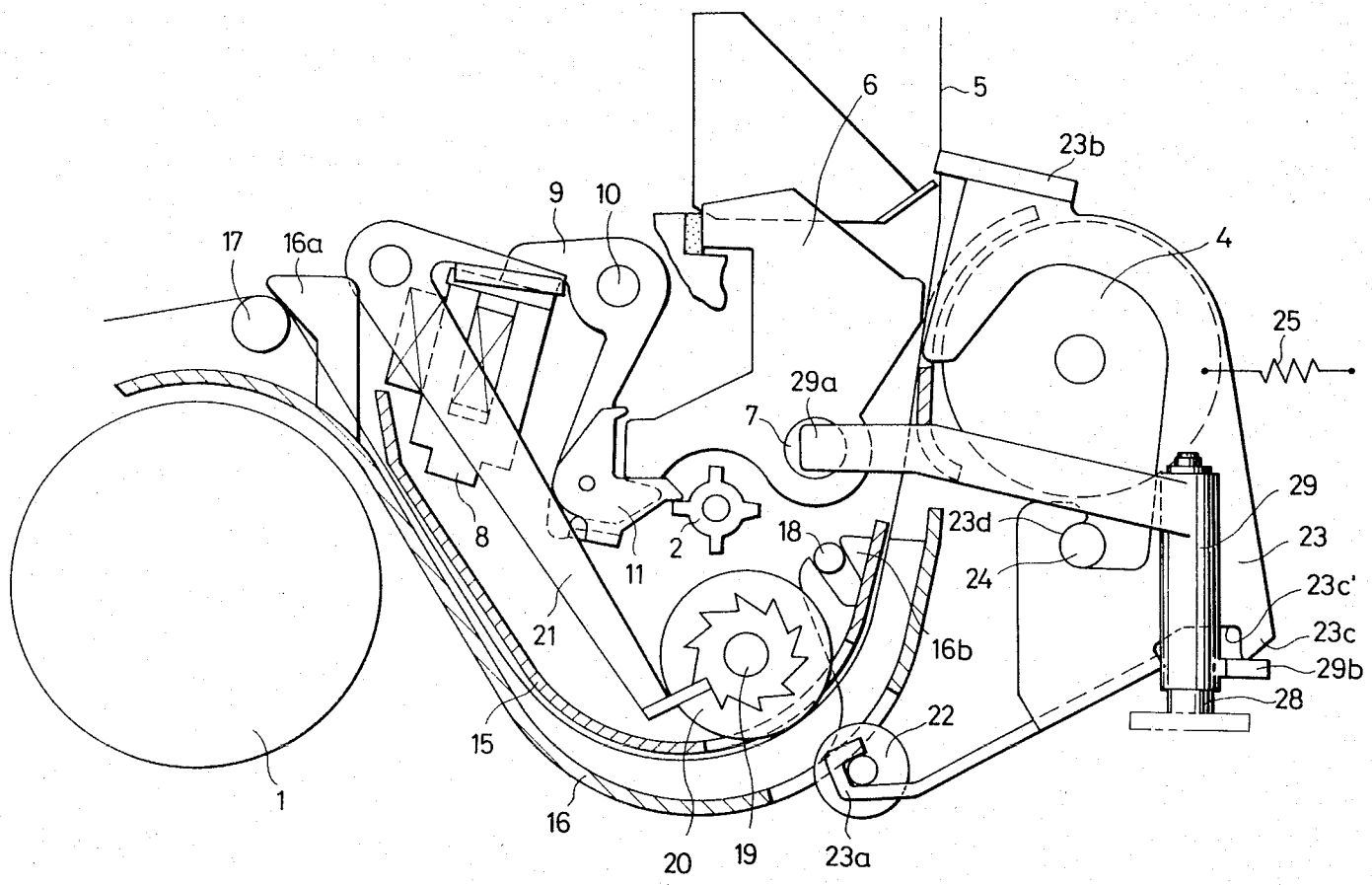
FIG. 3 is a side view similar to FIG. 1 in the state in which a guiding member is released.
Figure 4:
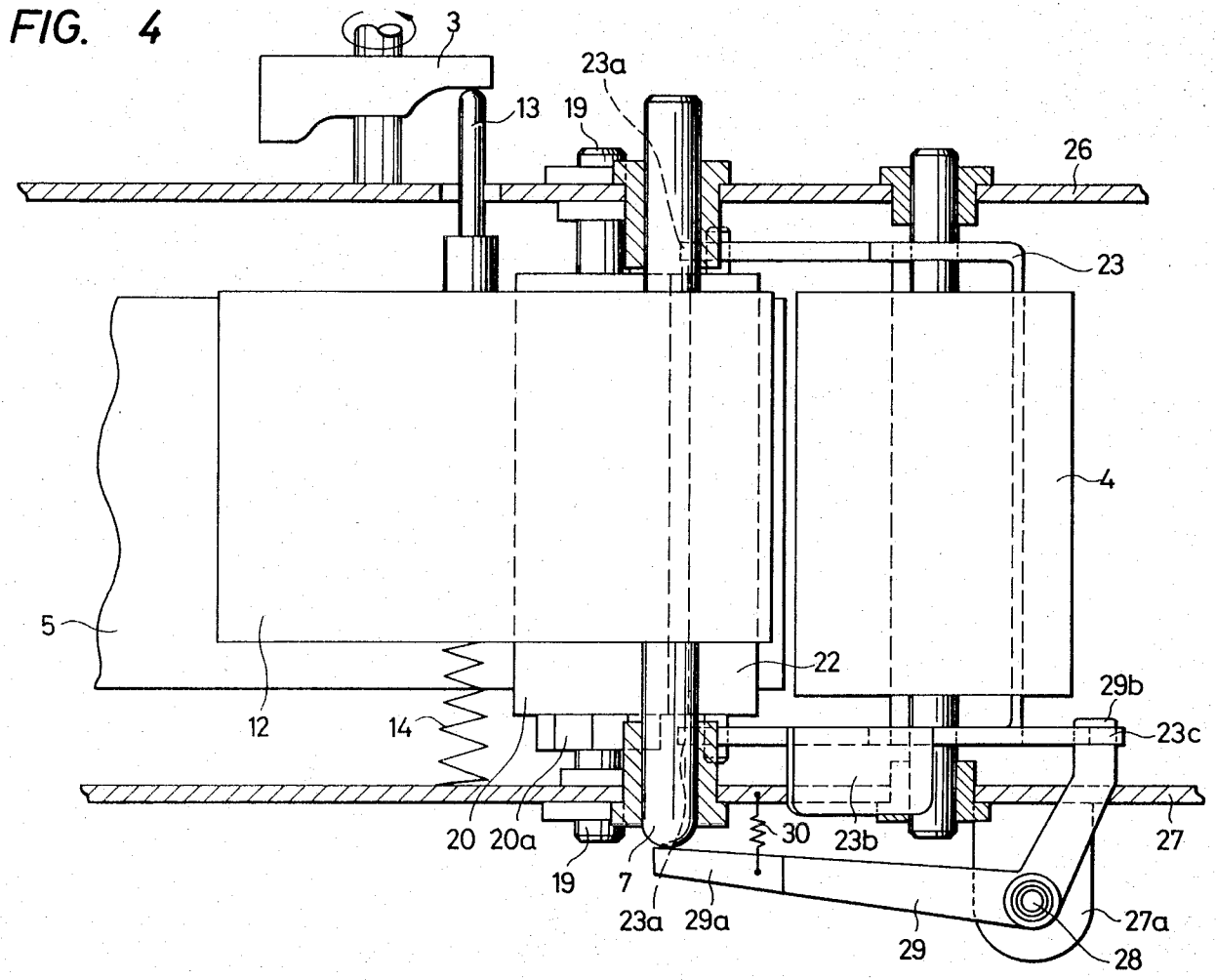
FIG. 4 is a plane view of FIG. 3.

Next, the operation of the paper feed release means shall be explained. When the printing paper 5 becomes jammed in the printing operation or when the printing paper needs to be extracted, it is necessary that the printing paper 5 is able to be taken out freely by releasing the guides 15 and 16 of the printing paper 5. This will be achieved by pressing the operating part 23*b* of the paper feed release lever 23 to the arrow direction. That is, when the operating part 23*b* is pushed in the arrow direction shown in FIG. 1, the paper feed release lever 23 will rotate counter-clockwise around the supporting shaft 24 as shown in FIG. 3, will separate the pressure roller 22 supported by the supporting part 23*a* from the paper feed roller 20, and will release simultaneously the printing paper 5 into a free condition by moving the lower guide 16 rightward and downward (as in FIG. 1), through the pins 17 and 18 and guiding arms 16*a* and 16*b* engaged with the pins 17 and 18. The engaging part 23*c* will be disengaged from the arm 29*b* of the lock release lever 29 by the counter-clockwise rotation of the paper feed release lever 23 to rotate clockwise the lock release lever 29 with the spring 30, and consequently to lock the engaging part 23*c* on the arm 29*b* by making it ridden on the arm 29*b* of the lock release lever 29 as shown in FIGS. 3 and 4. Next, when the printer is started in this locked condition, the operation cam 2 interlocked with the motor 1, the printing roller 4 and the stepped cam 3 will start to rotate, the hammer operating unit 12 will start to move from the position shown in FIG. 4 to the position shown in FIG. 2, and the supporting shaft 7 fixed to the printing hammer 6 will be simultaneously moved from the position shown in FIG. 4 to the position shown in FIG. 2. The lock release lever 29 will be rotated counter-clockwise by this movement of the supporting shaft 7 and will arrive in the position denoted by the dotted line in FIG. 2. In this way, when the arm 29*b* is disengaged from the engaging part 23*c* of the paper feed release lever 23, the paper feed release lever 23 will be rotated clockwise by the spring 25. At this time, a cut-off portion 23*c*′ of the engaging part 23*c* of the paper feed release lever 23 will engage with the arm 29*b* of the lock release lever 29, will further rotate the lock release lever 29 counter-clockwise, and will make certain that the supporting shaft 7 does not contact with the operation arm 29*a* in an ordinary printing operation. In the meantime, when the pressure roller 22 is again pressed on the paper feed roller 20 by this clockwise movement of the paper feed release lever 23, the lower guide 16 will be simultaneously moved leftward and upward, and ordinary paper feed condition will be realized again automatically.

Figure 5:
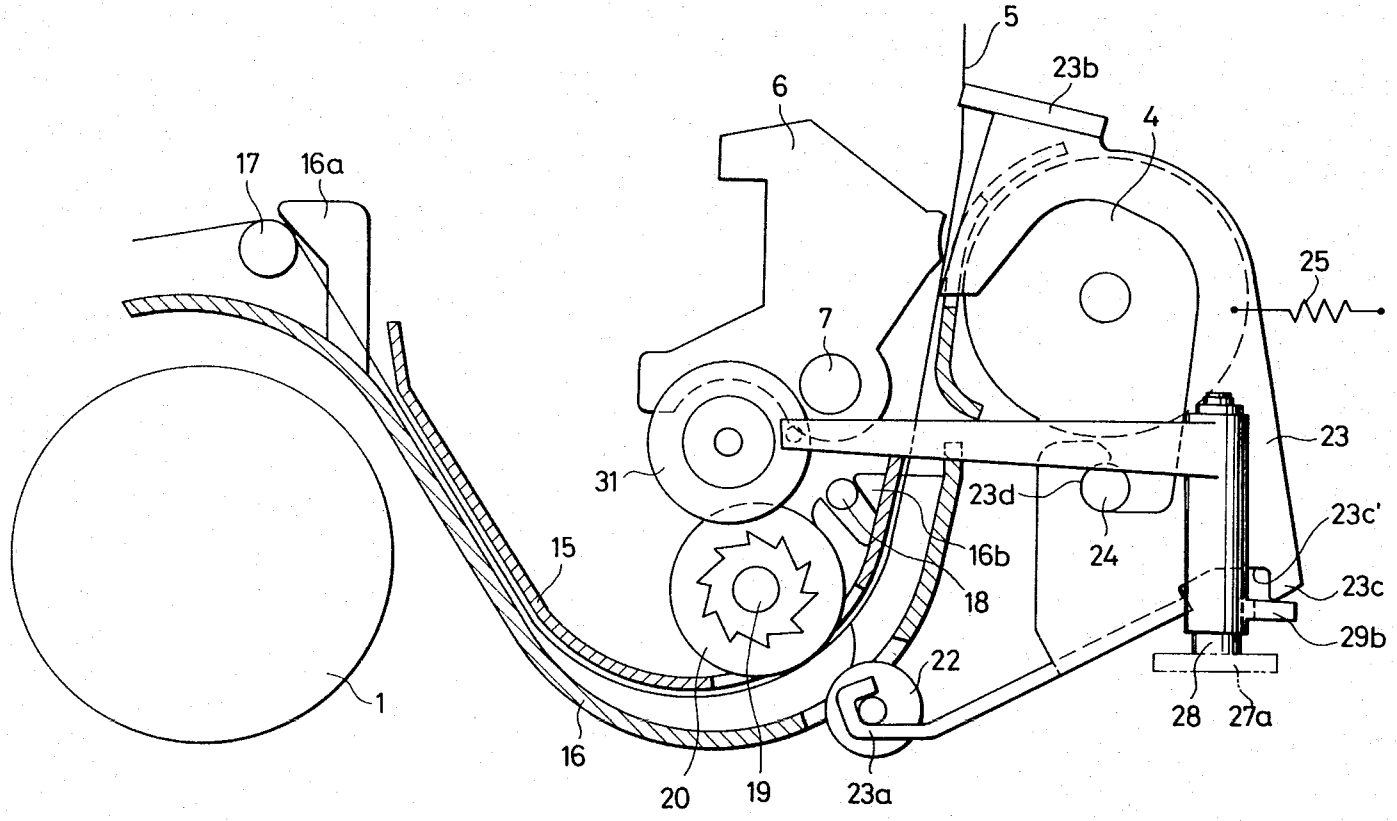
FIG. 5 is a side view of a printer provided with another embodiment of a printing paper feed release device according to the present invention.
Figure 6:
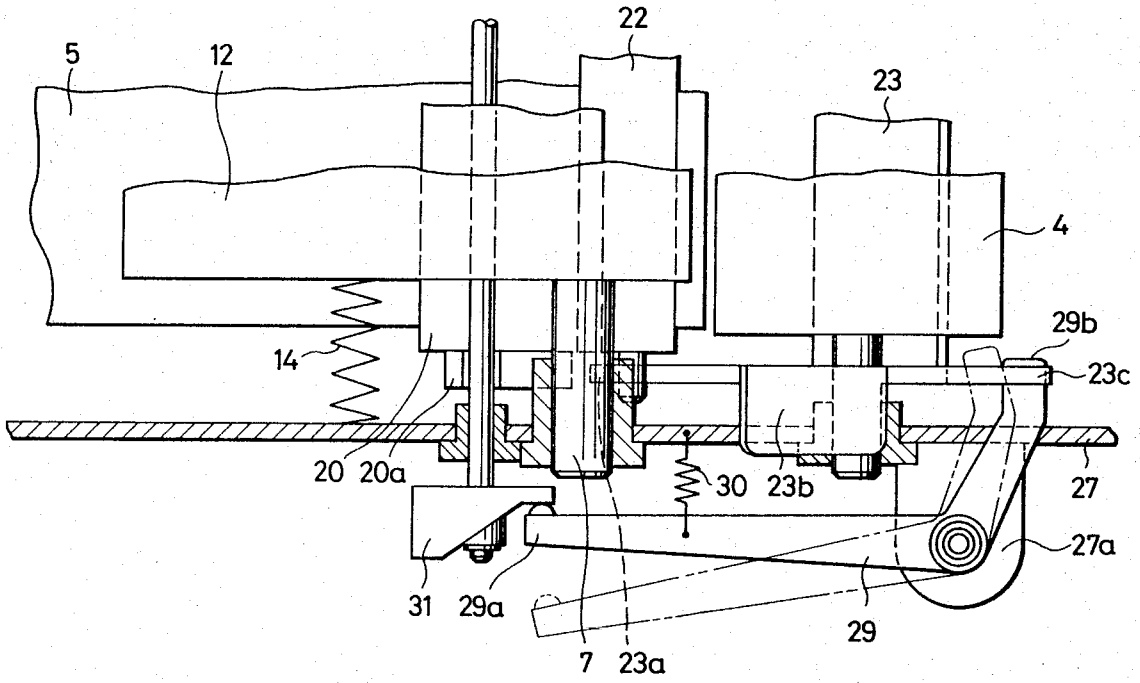
FIG. 6 is a plane view part of FIG. 5.

FIGS. 5 and 6 are respectively a side view and plane view to show pertinent parts of another embodiment according to the present invention, having the same numerals as the above described embodiment on the corresponding components of the same constitution and operation, and showing the locked state of it respectively. In these drawings, 31 denotes a cam disk interlocked with the motor 1 through a transmitting means (not illustrated), formed coaxially or integrally with the operating cam 2 of the above described embodiment, or able to be arranged at any other place through the above described transmitting means. In this embodiment, as a cam disk 31 to be interlocked with the motor 1 is used as a lock release means to release the engagement of the paper feed release lever 23, it is possible to release the engagement of the paper feed release lever 23 simultaneously with the restarting of the printer.

As described above, in the embodiments, the supporting shaft 7, or the cam disk 31, to move simultaneously with the restarting of the printer is used as a releasing means of the paper feed lever 23. However, any other member to operate simultaneously with or very shortly after the restarting of the printer may be used as this lock release means.

We claim:

1. A printing paper feed release device for a printer, comprising:

printing paper to be printed on;

a pressure roller engageable with said printing paper to support said printing paper thereon;

a paper feed release lever means, rotatably supporting said pressure roller thereon, for selectively disengaging said pressure roller from said printing paper;

a lock release lever, engageable with said paper feed release lever means, for locking said paper feed release lever means in a position wherein said pressure roller is disengaged from said printing paper;

a supporting shaft, engageable with said lock release lever, means for reciprocating said supporting shaft in its axial direction, said supporting shaft engaging and pivoting said lock release lever to automatically unlock said paper feed release lever means through said lock release lever when said printer is operated;

first spring means, connected to said lock release lever, for urging said lock release lever into engagement with said supporting shaft; and second spring means, connected to said paper feed release lever means, for urging said paper feed release lever means to make said pressure roller engage with said printing paper; wherein said lock release lever is rotated against said urging of said first spring means by movement of said supporting shaft to unlock said paper feed release lever means, and said paper feed release lever means is rotated by said urging of said second spring to move said lock release lever in a direction away from said supporting shaft.

* * * * *